United States Patent [19]

Stoppani

[11] 4,396,229

[45] Aug. 2, 1983

[54] MINING MACHINE WITH EXTERNALLY MOUNTED DRIVE MEANS

[75] Inventor: Brian R. Stoppani, Doncaster, England

[73] Assignee: Mining Supplies Limited, Doncaster, England

[21] Appl. No.: 197,333

[22] Filed: Oct. 15, 1980

[30] Foreign Application Priority Data

Oct. 19, 1979 [GB] United Kingdom ..... 7936341

[51] Int. Cl.[3] ..... E21C 29/22

[52] U.S. Cl. ..... 299/53; 299/43

[58] Field of Search ..... 299/42, 43, 51–54

[56] References Cited

U.S. PATENT DOCUMENTS

| | | | |
|---|---|---|---|
| 3,473,846 | 10/1969 | Lanfermann et al. | 299/43 |
| 3,594,043 | 7/1971 | Weber et al. | 299/42 |
| 4,045,083 | 8/1977 | Monks | 299/1 |
| 4,097,091 | 6/1978 | Knorr | 299/43 |
| 4,189,188 | 2/1980 | Schlipphaus et al. | 299/53 |
| 4,248,483 | 2/1981 | Parrott | 299/53 |

FOREIGN PATENT DOCUMENTS 1521772 8/1978 United Kingdom .

*Primary Examiner*—Ernest R. Purser

*Attorney, Agent, or Firm*—King and Liles

[57] ABSTRACT

A mining machine 1 of the shearer type comprises an elongate machine body 2 housing inter alia a power unit 11 for powering at least one rotary, mineral cutting head 10, and at least one haulage unit 12 mounted on the outside of the machine body. The haulage unit includes a variable speed motor 16, such as an electric AC motor. The motor is connected via speed reduction gearing 19 to a machine haulage sprocket 13 adapted to progressively engage rack bars 14 or a chain extending along the mineral face 5. A brake unit is also provided in the haulage unit. By locating one or more haulage units outside the machine body, the units can be located at appropriate locations, on either the goaf or face sides of the machine, or both sides, to suit particular operating conditions.

11 Claims, 5 Drawing Figures

MINING MACHINE WITH EXTERNALLY MOUNTED DRIVE MEANS

This invention relates to a mining machine of the shearer type adapted to be reciprocated along or adjacent an armoured scraper chain conveyor extending along a longwall mineral face.

Conventionally, such a shearer has been provided with a haulage unit incorporating a power output sprocket, around which sprocket was threaded a portion of a tensioned round link chain also extending along the mineral face, at the goaf side of the conveyor, and being staked at each end of the mineral face. Recently, however, this type of arrangement has been superseded by the so-called "chainless" haulage technique by which the staked haulage chain is eliminated, the machine being hauled on the rack and pinion principle with the "pinion" constituted either by at least one haulage sprocket, or by a relatively short endless chain, the "pinion" of either arrangement engaging, or being engaged by abutments, pockets, or projections provided on, in, or by rack bars mounted on the individual pans that conventionally make up the conveyor.

According to the present invention, a mining machine of the shearer type comprises an elongate machine body, housing, inter alia, a power unit for powering at least one rotary, mineral cutting head, and at least one haulage unit mounted on the outside of the machine body and comprising a variable speed motor connected via speed reduction gearing to a machine haulage sprocket adapted to engage progressively rack bars or a chain extending along the mineral face.

By locating the machine haulage unit outside the machine body, the haulage unit(s) may be fitted at the most appropriate location for particular operating conditions and hence is not "handed". Thus the haulage unit(s) may be located on either the goaf side or the face side of the machine.

It is usually desirable to provide two haulage units, each unit being spaced apart longitudinally of the machine body, thereby halving the loading on the individual teeth of the drive sprockets. When the haulage sprockets engage rack bars, this configuration ensures that the haulage sprocket of one haulage unit is positively engaged with a rack bar when the haulage sprocket of the other haulage unit is traversing a joint between adjacent rack bars. While the location of two haulage units both on the face side or both on the goaf side of the conveyor gives the advantage that rack bars are required only at the selected haulage side of the conveyor, it is also possible to provide two haulage units at the same end of the machine body, one operating on the goaf side and one operating on the face side of the conveyor. In yet another embodiment when heavy duty mining machines are involved, four haulage units may be provided, located approximately at each corner of the machine body.

A brake unit, which can be of a fail safe multi-disc type operable either electrically or hydraulically, may be interposed between the motor and the gearing of the or each haulage unit. Alternatively, the brake unit may be located within a flameproof casing of the motor.

Although the motor of each haulage unit can be hydraulic, it is preferred to employ electric motors, in which case variable speed A.C. motors are recommended. The motor of each unit may be rotatable about an axis extending transversely with respect to the longitudinal axis of the machine body or may be rotatable about an axis extending parallel to the longitudinal axis of the machine body, in which latter case the speed reduction gearing transmits the drive through 90°, e.g. by incorporating a pair of bevel gears, as the haulage sprocket is rotatable about an axis extending normally with respect to the electric motor axis of rotation. Although the drive sprocket could be rotatable about a generally vertical axis, it is preferably rotatable about a generally horizontal axis.

The invention will now be described in greater detail, by way of example, with reference to the accompanying drawings, in which.

Figure 1:
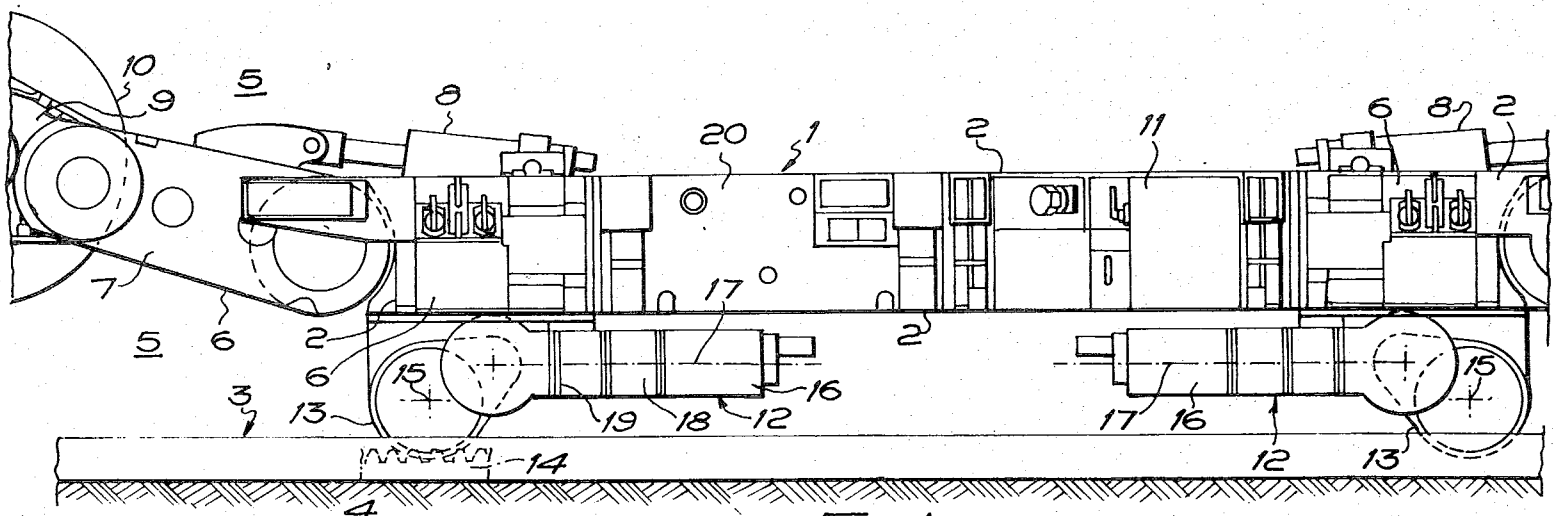
FIG. 1 is a side elevation, from the goaf side, of a shearer type mining machine in accordance with the present invention.

In the drawings is shown in shearer type mining machine 1 of the invention having an elongate machine body 2. Machine 1 is mounted on, and guided by, a scraper chain conveyor 3 seated on a mine floor 4 which extends along a mineral face 5.

The machine 1 is a double-ended ranging drum shearer comprising, at each end of the machine body 2, a gearhead 6 pivotally carrying a ranging arm 7 under the control of a double-acting, hydraulic, piston and cylinder unit 8, the ranging arm 7 carrying a secondary ranging arm 9 on which is mounted a rotary, pick-carrying cutting head 10 to remove mineral from the face 5. The machine body 2 further comprises a motor unit 11 housing an electric motor to power the two cutting heads 10. At the face side of the machine body 2 are located a pair of spaced apart haulage units 12 each comprising a drive sprocket 13 in engagement with a rack element 14 secured to the conveyor 3. Each sprocket 13 is rotatable about an axis 15 extending laterally of the longitudinal axis of the machine body 2. Each haulage unit 12 further comprises an electric motor 16, rotatable about an axis 17 extending parallel to the longitudinal axis of the machine body 2, a brake unit 18 and a speed reduction gearbox 19, the haulage units 12 being located outside the machine body 2 and under the control of a unit 20 forming part of the machine body 2 and located between the motor unit 11 and one of the gearheads 6. To transmit drive from the motor axis 17 to the drive sprocket axis 15, the gearboxes 19 each drive through 90° by incorporating bevel gears 21, 22. At the goaf side of the machine body 2, the latter is supported in a conventional manner on slide shoes or rollers (not shown) engaging the conveyor 3. The electric motor 16 is preferably of the variable speed a.c. type, while the brake unit 18 is of an electrically or hydraulically operated, fail-safe, multi-disc type. Thus, the brake units 18 are each spring loaded into the braking condition and electrically or hydraulically released from the braking condition.

Figure 2:
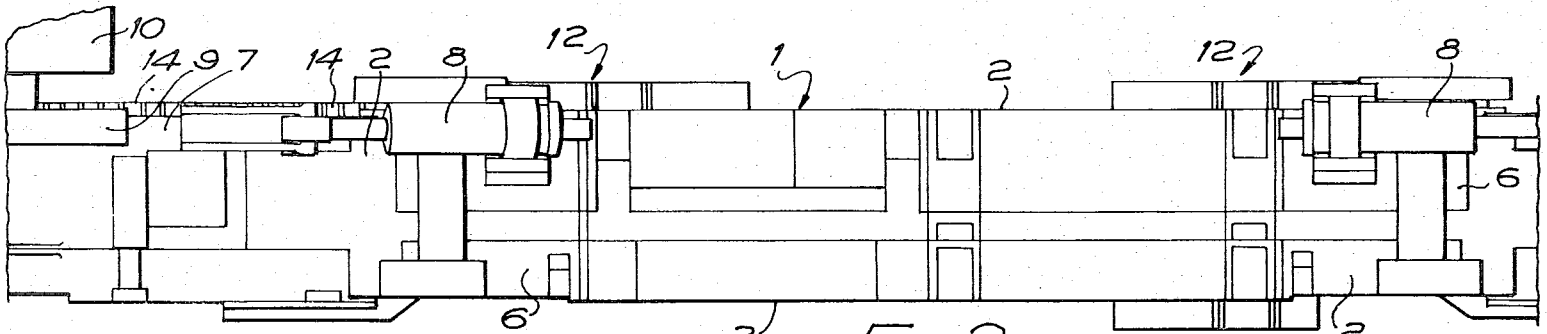
FIG. 2 is a plan view of FIG. 1.
Figure 3A:
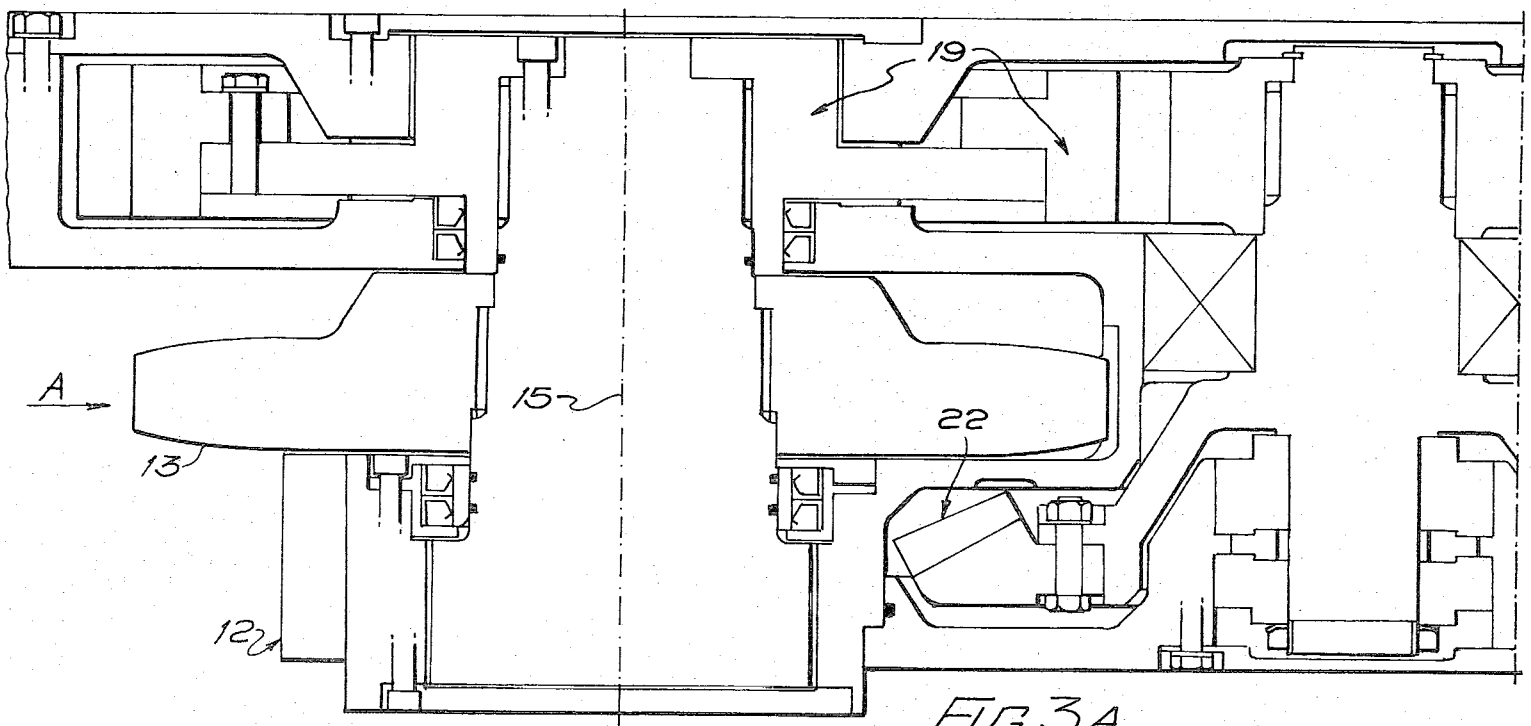
FIGS. 3A and 3B are respectively longitudinal sectional views through a haulage unit shown in FIGS. 1 and 2.
Figure 3B:
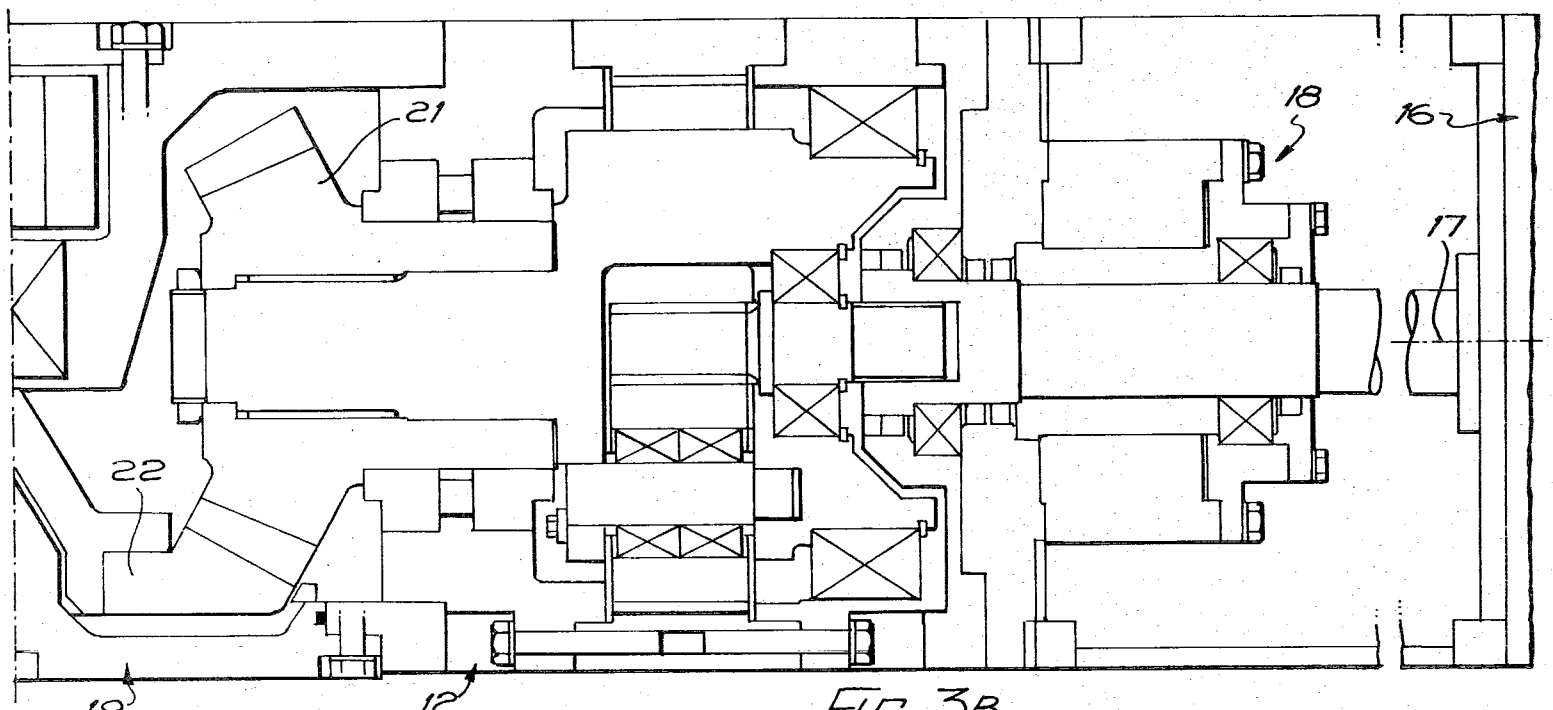
Figure 4:
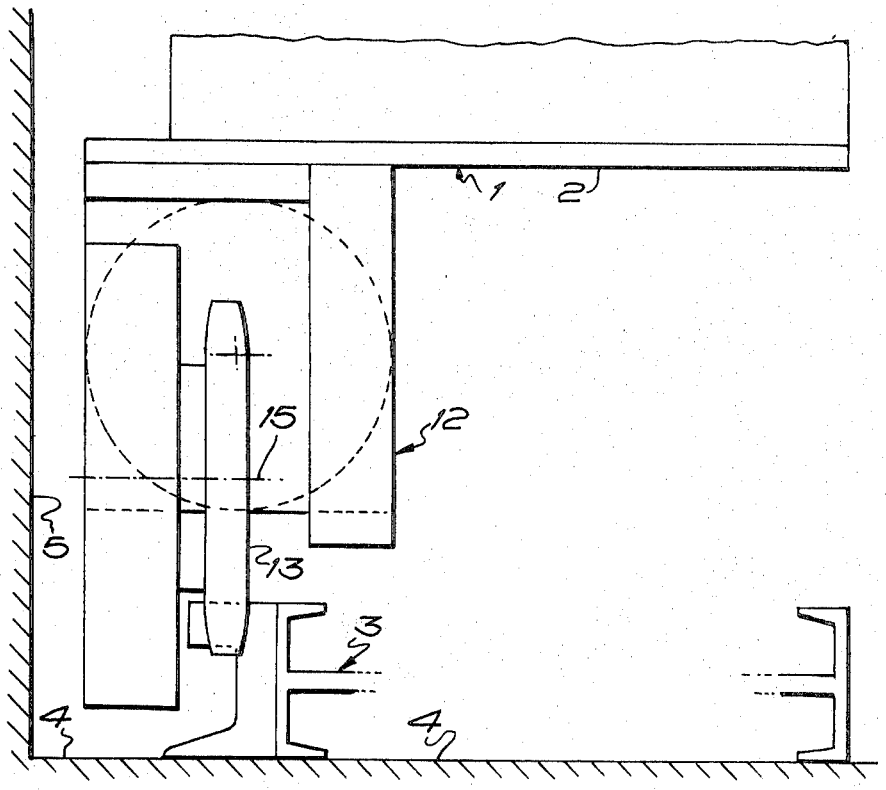
FIG. 4 is a view in the direction of arrow A in FIG. 3A.

As shown in FIG. 2, in schematic form, a haulage unit 12' (similar to unit 12) can also be mounted externally on the goaf side of body 2 depending upon particular operating conditions.

What I claim is:

1. A mining machine of the shearer type comprising an elongated machine body; a power unit housed within said machine body and powered by said power unit, and, at least one haulage unit mounted externally from said machine body, said externally mounted haulage unit including a brake unit and a variable speed electric motor means, a machine haulage sprocket, and speed reduction gearing means operatively interconnecting said motor means to said sprocket.

2. A mining machine as claimed in claim 1, wherein said haulage unit is mounted externally on the face side of said machine.

3. A mining machine as claimed in claim 1 wherein at least two of said haulage units are provided, each said unit being spaced apart from each other longitudinally of said machine body.

4. A mining machine as claimed in claim 1, wherein said brake unit is hydraulically operable.

5. A mining machine as claimed in claim 1, wherein said brake unit is interposed between said motor means and said reduction gearing means.

6. A mining machine as claimed in claim 1, wherein said brake unit is of a fail-safe multi-disc type.

7. A mining machine as claimed in claim 1, wherein said electric motor is a variable speed A.C. motor.

8. A mining machine as claimed in claim 1, wherein said motor means is rotatable about an axis extending parallel to the longitudinal axis of said machine body.

9. A mining machine as claimed in claim 8, wherein said speed reduction gearing means includes a pair of bevel gears to translate the motor drive through approximately 90°.

10. A mining machine as claimed in claim 1, wherein said haulage sprocket is rotatable about a substantially horizontal axis.

11. A mining machine according to claim 1, wherein said haulage unit is mounted externally on the goaf side of said machine.

* * * * *